United States Patent [19]

Abe et al.

[11] Patent Number: 4,679,540

[45] Date of Patent: Jul. 14, 1987

[54] IGNITION SYSTEM

[75] Inventors: Masao Abe, Asaka; Nobuo Miura, Wako, both of Japan

[73] Assignee: Honda Giken Kogyo Kabushiki Kaisha, Tokyo, Japan

[21] Appl. No.: 924,190

[22] Filed: Oct. 27, 1986

Related U.S. Application Data

[63] Continuation of Ser. No. 775,877, Sep. 13, 1985, abandoned.

[30] Foreign Application Priority Data

Sep. 13, 1984 [JP] Japan ..... 59-193414

[51] Int. Cl.[4] ..... F02P 3/06

[52] U.S. Cl. ..... 123/602; 123/603; 123/632

[58] Field of Search ..... 123/603, 631, 632, 179 BG, 123/609, 644, 141.50, 179 A, 179 B, 179 R, 602

[56] References Cited

U.S. PATENT DOCUMENTS

| | | | |
|---|---|---|---|
| 3,824,976 | 7/1974 | Katsumata et al. | 123/603 |
| 3,861,369 | 1/1975 | Canup | 123/632 |
| 4,014,309 | 3/1977 | Nagasawa | 123/603 |
| 4,080,940 | 3/1978 | Fuzzell et al. | 123/603 |
| 4,116,188 | 9/1978 | Nagasawa | 123/603 |
| 4,132,208 | 1/1979 | Yukawa | 123/602 |
| 4,164,157 | 8/1929 | Kudo et al. | 123/602 |
| 4,273,093 | 6/1981 | Ozawa | 123/602 |
| 4,335,692 | 6/1982 | Miura | 123/602 |
| 4,356,809 | 11/1982 | Lo Coscio | 123/632 |
| 4,404,952 | 9/1983 | Fujimoto et al. | 123/602 |
| 4,453,506 | 6/1984 | Ueda et al. | 123/179 BG |
| 4,510,396 | 4/1985 | Uchida et al. | 123/179 BG |

*Primary Examiner*—Raymond A. Nelli

*Attorney, Agent, or Firm*—Pollock, Vande Sande & Priddy

[57] ABSTRACT

The present invention is an ignition device comprising a circuit for generating an ignition signal in synchronism with the revolutions of an engine, a circuit for inhibiting an igniting operation, a circuit for detecting the starting state of the engine, and a circuit for interrupting the operation of the inhibiting circuit upon detection of such starting state.

1 Claim, 2 Drawing Figures

IGNITION SYSTEM

This application is a continuation of application Ser. No. 775,877, filed Sept. 13, 1985, now abandoned.

FIELD OF THE INVENTION

The present invention relates to an ignition device comprising a circuit for generating an ignition signal in synchronism with the revolutions of an engine, a circuit for inhibiting an igniting operation, a circuit for detecting the starting state of the engine, and a circuit for interrupting the operation of the inhibiting circuit upon detecton of such starting state.

BRIEF DESCRIPTION OF THE DRAWINGS

The present invention will now be described in connection with a preferred embodiment thereof with reference to the accompanying drawings in which.

BACKGROUND OF THE INVENTION

Figure 1:
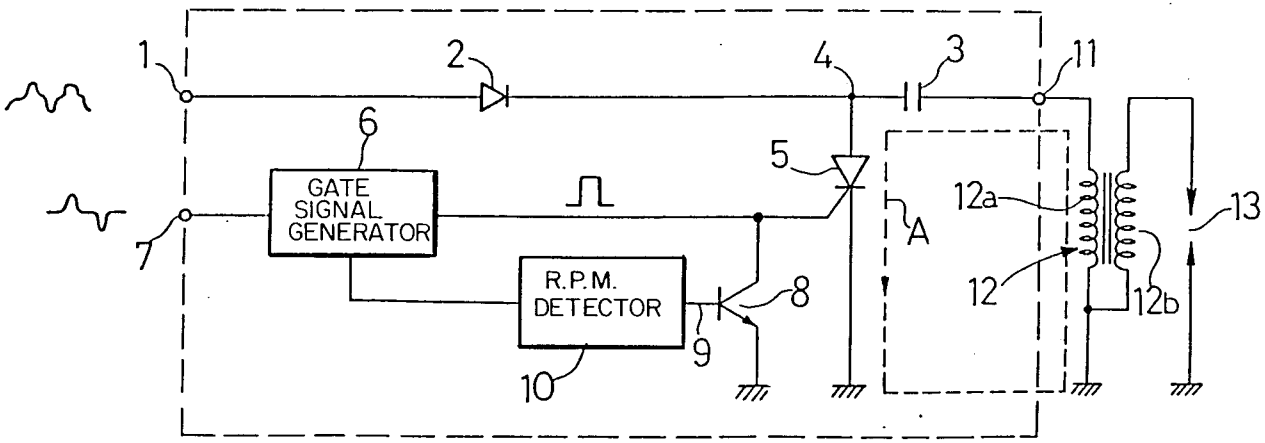
FIG. 1 is a circuit diagram showing a capacitor discharge type ignition device of the prior art.

FIG. 1 is a circuit diagram showing a prior art capacitor discharge type ignition device. A terminal 1 is connected with the output terminal of an a.c. generator which is mounted on a vehicle. An a.c. voltage fed to terminal 1 is rectified by a diode 2 and is supplied to a capacitor 3. The latter is charged on the basis of that rectified voltage. Between the plus terminal 4 of capacitor 3 and the ground, there is connected in a forward direction a thyristor 5 which has its gate terminal connected with the output terminal of a gate signal generator 6. A pulse signal concerning the ignition timing is inputted to the input terminal 7 of gate signal generator 6. Between the gate terminal of thyristor 5 and the ground, moreover, there is connected an npn type transistor 8 which has its base 9 connected with the output terminal of an r.p.m. detector 10 made receptive of the output signal of the aforementioned gate signal generator 6 for detecting a predetermined r.p.m. of the engine. On the other hand, the primary coil **12*a* of an ignition coil 12 is connected between the minus terminal 11 of capacitor 3 and the ground, and an ignition plug 13 is connected between the insulated terminal of the secondary coil 12*b* of ignition coil 12** and the ground.

When gate signal generator 6 outputs a positive pulse to capacitor 3 charged, according to the construction described above, thyristor 5 is rendered conductive so that a discharge current flows, as indicated by broken lines A. As a result, a high voltage is induced in secondary coil **12*b* to ignite ignition plug 13. As a result of repetitions of the charge of capacitor 3 and the generation of the positive pulses of gate signal generator 6, periodic ignitions are continued in ignition plug 13** to effect the igniting operation.

At the start of the engine, however, backward torque may be generated in the engine if the starting r.p.m. of the engine is inadequate. In order to prevent this, the weight of the engine is increased in order to enhance its strength.

In view of this, according to the prior art, a signal for turning on the transistor 8 is outputted, when the r.p.m. detected by the r.p.m. detector 10 is no greater than a predetermined value, to ground the gate terminal of thyristor 5 through transistor 8. for this purpose, thyristor 5 is held inconductive to inhibit the igniting operation of the ignition plug 13.

In case a starter motor is to be used for starting the engine which is equipped with the ignition device having the above-specified construction, ignition plug 13 is not able to perform its igniting operation, therby to leave the engine start impossible, unless the engine r.p.m. is increased to exceed the predetermined value. This unnecessarily results in an increase in the output of the starter motor and in the capacity of the battery. As a result, these devices must have their sizes and weights enlarged.

SUMMARY OF THE INVENTION

In the ignition device for inhibiting the igniting operation to block the generation of the backward torque of the engine when the engine r.p.m. is small, the present invention contemplates to release the inhibition of the starting operation only at the start of the engine, thereby to make the igniting operation possible from a small r.p.m. so that the size of the starter motor and the capacity of the battery may be reduced.

DETAILED DESCRIPTION

Figure 2:
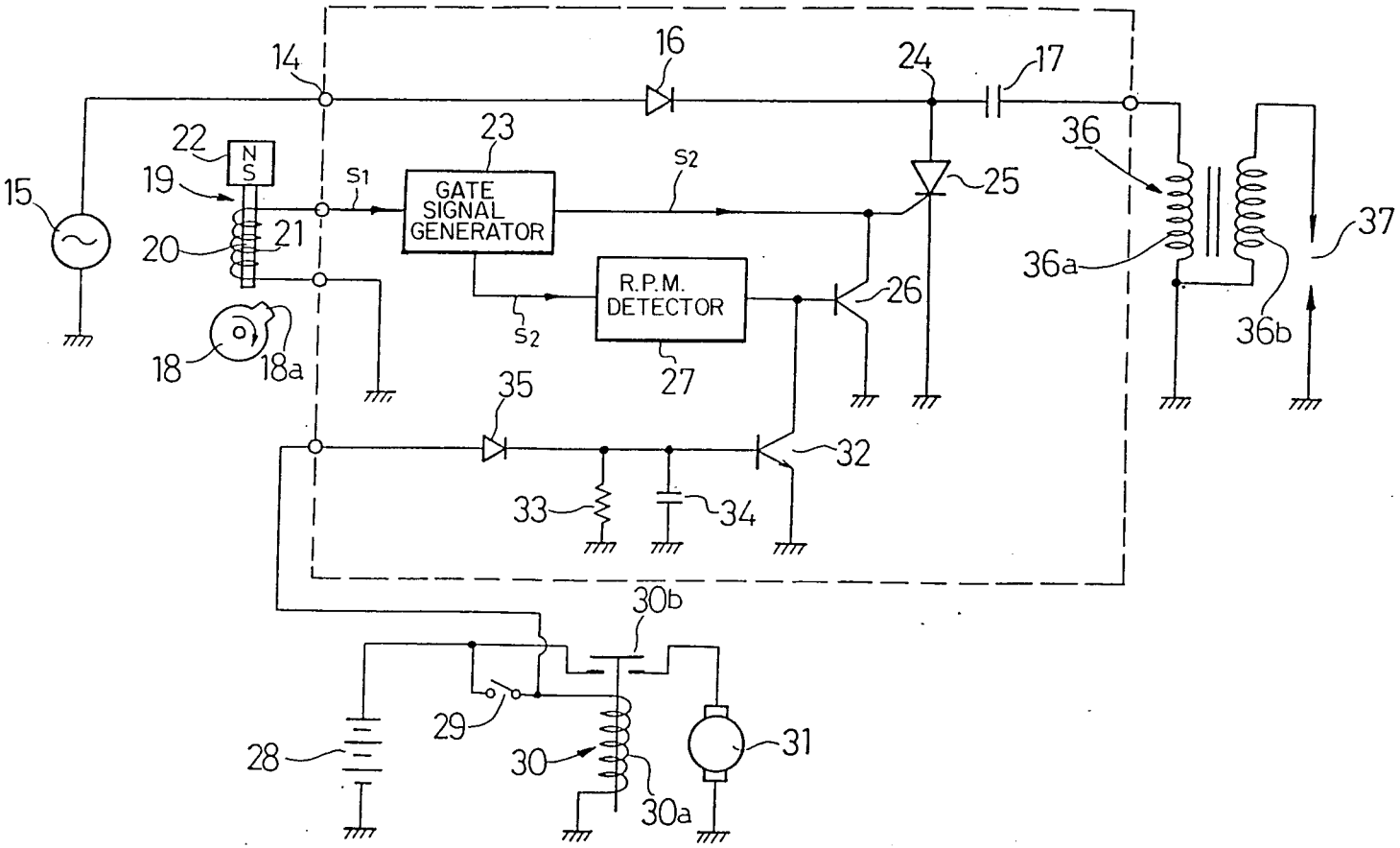
FIG. 2 is a circuit diagram showing a similar device according to the present invention.

With a terminal 1, as shown in FIG. 2, there is connected the output terminal of an a.c. generator which is attached to the engine of a vehicle. Reference numeral 15 indicates the a.c. generator as an a.c. power supply. An a.c. voltage signal fed to the terminal 14 from the a.c. generator 15 is rectified by a diode 16 and is then supplied to a capacitor 17. The capacitor 17 is caused to conduct its charging operation by the voltage supplied thereto.

Reference numeral 18 indicates a rotor which is formed with a projection **18*a* and which is made of a ferromagnetic material. The rotor 18 is made rotatable with the crankshaft (not shown) of the engine. In the vicinity of the rotor 18, there is arranged an electromagnetic pickup 19 which has its magnetic core 20 wound by a pulser coil 21 and which is biased by a permanent magnet 22. When the rotor 18 revolves in the direction of the arrow so that its projection 18*a* passes over the front of the magnetic core 20 of the electromagnetic pickup 19, there is generated at the output terminal of the pulser coil 21** a signal $S_1$ which is synchronized with the revolutions of the engine.

Reference numeral 23 indicates a gate signal generator which is made receptive of the aforementioned signal $S_1$ synchronized with the engine revolutions to output an ignition signal $S_2$ which is composed of a positive pulse signal corresponding to the ignition timing. Between the plus terminal 24 of the aforementioned capacitor 17 and the ground, on the other hand, there is connected a thyristor 25 which is directed forward to the ground. The output terminal of the gate signal generator 23 is connected with the gate terminal of the thyristor 25. Moreover, an npn type transistor 26 is connected between the gate terminal of the thyristor 25 and the ground. Numeral 27 indicates an r.p.m. detector which has its output terminal connected with the base of the transistor 26. The r.p.m. detector 27 is made receptive of the output signal $S_2$ of the aforementioned gate signal generator 23 to apply an output signal for turning off the transistor 26 to the base of the transisitor 26 when the engine r.p.m. becomes equal to or smaller than a predetermined value smaller than the idling value.

Next, reference numeral 28 indicates a battery which is mounted on the vehicle. Between the anode of the battery 28 and the ground, there are connected in series a starter switch 29 and an exciting oil 30*a* of a relay switch 30, and a normally open relay contact 30*b* of the relay switch 30 and a starter motor 31. Between the base of the aforementioned transistor 26 and the ground, on the other hand, there is connected an npn type transistor 32 having a base and an emitter, between which is connected a parallel circuit composed of a resistor 33 and a capacitor 34. Moreover, the earthed terminal of the starter switch 39 and the base of the transistor 32 are connected through a diode 35.

Moreover, reference numeral 36 indicates an ignition coil which has its primary coil 36*a* connected between the minus terminal of the capacitor 17 and the ground. An ignition plug 37 is connected with a high-voltage terminal of a secondary coil 36*b* and the ground.

With the construction thus far described, while the engine is running, the a.c. voltage signal outputted from the a.c. generator 15 is rectified to charge the capacitor 17. When the engine r.p.m. is not smaller than the value which is predetermined by the r.p.m. detector 27, the transistor 26 is in its off state. As a result, the ignition signal $S_2$ outputted from the gate signal generator 23 on the basis of the signal $S_1$ outputted from the pulser coil 21 is supplied to the gate terminal of the thyristor 25 to periodically render the thyristor 25 conductive in synchronism with the revolutions of the engine. Each time the thyristor 25 is rendered conductive, the capacitor 17 is discharged to induce a high voltage in the secondary coil 36*b* of the ignition coil 36 so that ignition plug 37 sparks.

When the engine r.p.m. is not larger than the predetermined value set by the r.p.m. detector 27, the transistor 26 is turned on to earth the gate terminal of the thyristor 25 to the ground. In this case, therefore, the thyristor 25 is left inconductive even if the gate signal generator 23 outputs the ignition signal $S_2$. As a result, the discharge of the capacitor 17 is blocked so that the ignition plug 37 does not spark. Thus, when the engine r.p.m. is equal to or smaller than the predetermined value set by the r.p.m. detector 27, the igniting operation of the ignition plug 37 can be inhibited to prevent backward torque of the engine from being established.

When starter switch 29 is turned on for starting the engine to run the starter motor 31, the existing coil 30*a* is energized, so that the relay contact 30*b* is closed to supply the starter motor 31 with electric power. At this time, the current supplied from the battery 28 is adjusted to have a predetermined voltage through the diode 35, and is applied to the base of the transistor 32 to turn on the transistor 32. When transistor 32 is turned on, the base of the transistor 26 is earthed to the ground so that the transistor 26 can be held inconductive even if the r.p.m. detector 27 outputs its output signal. As a result, at the start of the engine by the starter motor 31, the thyristor 25 can be turned on or off by the ignition signal outputted from the gate signal generator 23, even in case the engine r.p.m. is smaller than the value set by the r.p.m. detector 27. Thus, the capacitor 17 is enabled to conduct its charging and discharging operations so that the ignition plug 37 is allowed to perform its igniting operation.

After the start of the engine is completed, the starter switch 29 is turned off to render the transistor 32 inconductive. As a result, the conductive and inconductive states of the transistor 26 restore the aforementioned normal state which is controlled by the output signal of the r.p.m. detector 27.

At the start of the engine, as has been described above, the operation of the circuit composed of the r.p.m. detector 27 and the transistor 26 for inhibiting the ignition operation is interrupted. As a result, the ignition circuit can be run at a remarkably small r.p.m. even at the start of the engine, so that the engine can be started even by a small-sized starter motor and a small-capacity battery.

It will be clear from the foregoing description that, according to the present invention, the structure for making the operation of the igniting operation inhibiting circuit impossible at the engine start is added to the ignition device which is constructed to inhibit the igniting operation when the engine r.p.m. is at a low value satisfying the predetermined conditions. As a result, the igniting operation at low r.p.m. is made possible only at the engine start to drop the r.p.m. of the starter motor necessary for starting the engine to permit reduction of the size of the starter motor and the capacitor of the battery mounted on the vehicle.

What is claimed is:

1. An ignition circuit for an internal combustion engine comprising (a) an ignition circuit generating an ignition timing signal, (b) an inhibition circuit comprising an r.p.m. detector circuit and a first gating circuit shunting said first gating circuit in response to output from said r.p.m. detector circuit, for inhibiting generation of said ignition timing signal when the r.p.m. of said engine is below a predetermined value;

(c) an interruption circuit comprising series connection of a second gating circuit to said inhibition circuit and a time-constant-discharge-circuit comprising a parallel connection of a resistor and a capacitor, and a diode preventing rapid discharge of said capacitor;

(d) said time constant discharge circuit shunting said second gating circuit and preventing operation for said inhibition circuit in response to charged voltage in said capacitor when a starter switch is in "ON" position, and continuing to shunt said second gating circuit and to prevent operation of said inhibition circuit in the "ON" position of said starter switch and for a constant time period, just after said starter switch is turned to "OFF" position in response to still charged voltage in said capacitor.

* * * * *